US011021220B2

(12) United States Patent
Yamamoto et al.

(10) Patent No.: US 11,021,220 B2
(45) Date of Patent: Jun. 1, 2021

(54) BOAT MANEUVERING SUPPORT DEVICE

(71) Applicant: HONDA MOTOR CO., LTD., Tokyo (JP)

(72) Inventors: Hiroshi Yamamoto, Saitama (JP); Akifumi Fujima, Saitama (JP); Yoshihiro Harada, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/643,458

(22) PCT Filed: Oct. 3, 2017

(86) PCT No.: PCT/JP2017/036032
§ 371 (c)(1),
(2) Date: Feb. 28, 2020

(87) PCT Pub. No.: WO2019/069382
PCT Pub. Date: Apr. 11, 2019

(65) Prior Publication Data

US 2020/0255103 A1 Aug. 13, 2020

(51) Int. Cl.
*B63B 79/40* (2020.01)
*B63B 79/10* (2020.01)
*B63H 20/12* (2006.01)

(52) U.S. Cl.
CPC ..... *B63B 79/40* (2020.01); *B63B 79/10* (2020.01); *B63H 20/12* (2013.01)

(58) Field of Classification Search
CPC ..... B63B 79/40; B63B 79/10; B63B 79/00; B63H 20/12; B63H 25/02; B63H 21/21;
(Continued)

(56) References Cited

U.S. PATENT DOCUMENTS 8,170,734 B2 * 5/2012 Kaji ..... B63H 25/02 701/21
2009/0076671 A1 3/2009 Mizutani
(Continued)

FOREIGN PATENT DOCUMENTS

JP H08-142992 A 6/1996
JP 2001-334995 A 12/2001
(Continued)

OTHER PUBLICATIONS

Dec. 12, 2017, International Search Report issued for related PCT Application No. PCT/JP2017/036032.
(Continued)

*Primary Examiner* — Anthony D Wiest
(74) *Attorney, Agent, or Firm* — Paratus Law Group, PLLC

(57) ABSTRACT

There is provided a boat maneuvering support device for a boat including an outboard motor, a power device which outputs a thrust force in a port-starboard direction, and a steering mechanism which changes a steering angle. The device includes a rotational speed detection unit which detects a rotational speed of a propeller of the outboard motor, and a control unit which controls a magnitude of the thrust force output by the power device. The control unit controls the magnitude of the thrust force output by the power device so as to change a balance between a magnitude of a first turning force which makes the boat turn by a thrust force of the outboard motor and a magnitude of a second turning force which makes the boat turn by the thrust force of the power device.

5 Claims, 5 Drawing Sheets

(58) Field of Classification Search
CPC ..... B63H 25/42; B63H 21/26; B63H 21/265; B63H 21/28
USPC ..... 701/21; 114/144 R; 440/84
See application file for complete search history.

(56) References Cited

U.S. PATENT DOCUMENTS

| | | | |
|---|---|---|---|
| 2009/0105894 | A1 | 4/2009 | Yamamura et al. |
| 2009/0224132 | A1 | 9/2009 | Mochizuki |
| 2014/0046515 | A1 | 2/2014 | Mizutani |
| 2016/0096611 | A1 | 4/2016 | Suzuki et al. |

FOREIGN PATENT DOCUMENTS

| | | | |
|---|---|---|---|
| JP | 2008-222082 | A | 9/2008 |
| JP | 2009-067287 | A | 4/2009 |
| JP | 2009-101716 | A | 5/2009 |
| JP | 2009-208654 | A | 9/2009 |
| JP | 2014-034269 | A | 2/2014 |
| JP | 2016-074250 | A | 5/2016 |

OTHER PUBLICATIONS

Dec. 12, 2017, International Search Opinion issued for related PCT Application No. PCT/JP2017/036032.
Feb. 24, 2021, Japanese Office Action issued for related JP application No. 2019-546451.

* cited by examiner

BOAT MANEUVERING SUPPORT DEVICE

CROSS REFERENCE TO PRIOR APPLICATION

This application is a National Stage Patent Application of PCT International Patent Application No. PCT/JP2017/036032 (filed on Oct. 3, 2017) under 35 U.S.C. § 371, which is hereby incorporated by reference in its entirety.

TECHNICAL FIELD

The present invention relates to a boat maneuvering support device for a boat including an outboard motor whose steering angle is variable and a power device which outputs a thrust force in a port-starboard direction of the boat.

BACKGROUND ART

Patent Document 1 describes a boat maneuvering system which can operate an outboard motor mounted on a rear portion of a hull and thrusters provided at front and rear of the hull (bow and stern) by an operating device including a steering wheel for steering the hull, a remote controller for operating a shift and an output of the outboard motor, and a joystick for steering the hull.

PRIOR ART DOCUMENT

Patent Document

Patent Document 1: JP-A-2016-74250

SUMMARY OF THE INVENTION

Problems to be Solved by the Invention

According to the boat maneuvering system described in Patent Document 1, although it is possible to operate both the outboard motor and the thrusters by an operation of the operating device, the control of changing a balance of the magnitudes of respective outputs from the outboard motor and the thrusters according to a state of the boat is not performed. Therefore, the thrusters in the boat maneuvering system are used when the boat leaves and moves toward a coast but not used when the boat is traveling.

However, it is conceivable that turning performance of the boat can be improved if thrusters with limited use situations such as when the boat leaves and moves toward a coast are also used when the boat is traveling. However, the degree of contribution of improving the turning performance by the thrusters would vary according to the state of the boat. For example, when a boat is traveling at a high speed, since a sufficient turning force can be obtained from an output of the steered outboard motor, an excessive turning force is generated even when the thrusters are used. On the other hand, when the boat is traveling at low speed, since a sufficient turning force cannot be obtained from the output of the steered outboard motor, a necessary turning force can be obtained if the turning force is added using the thrusters.

Accordingly, an object of the present invention is to provide a boat maneuvering support device capable of generating a necessary turning force regardless of a state of a boat.

Means for Solving the Problems

The present invention provides the following aspects.

According to a first aspect, there is provided a boat maneuvering support device including an outboard motor which is mounted on a stern of the boat and whose steering angle is variable (for example, an outboard motor 12 in an embodiment to be described later), a power device which is configured to output a thrust force in a port-starboard direction of the boat (for example, a thruster 30 in the embodiment), and a steering mechanism which is configured to change the steering angle (for example, a steering wheel 24 in the embodiment). The boat maneuvering support device includes: a rotational speed detection unit which is configured to detect a rotational speed of a propeller of the outboard motor (for example, a rotational speed detection unit 41 in the embodiment); and a control unit which is configured to control a magnitude of the thrust force output by the power device according to at least one of the rotational speed of the propeller and the steering angle corresponding to the operation of the steering mechanism (for example, a control unit 43 in the embodiment), wherein the control unit is configured to control the magnitude of the thrust force output by the power device so as to change a balance between a magnitude of a first turning force which makes the boat turn by a thrust force of the outboard motor and a magnitude of a second turning force which makes the boat turn by the thrust force of the power device.

A second aspect provides the boat maneuvering support device of the first aspect, wherein a sum of the first turning force and the second turning force is equal to a turning force required for realizing a predetermined turning performance of the boat.

A third aspect provides the boat maneuvering support device of the first aspect or the second aspect, wherein the control unit is configured to increase a rate of the second turning force as the rotational speed of the propeller or the steering angle decreases.

A fourth aspect provides the boat maneuvering support device of any one of the first to third aspects, wherein when the steering mechanism is operated in a state where the outboard motor is in a neutral state, the control unit is configured to control the power device to generate the second turning force.

A fifth aspect provides the boat maneuvering support device of any one of the first to fourth aspects, wherein when the steering mechanism is operated at an angular velocity equal to or higher than a threshold in a state where the rotational speed of the propeller is equal to or higher than a predetermined value, the control unit is configured to limit the steering angle to an upper limit value and control the power device to output the thrust force in a direction opposite to a turning direction.

A sixth aspect provides the boat maneuvering support device of any one of the first to fifth aspects, wherein an angle of an output direction of the thrust force of the power device with respect to the port-starboard direction is changeable on a horizontal plane, and wherein in a case of controlling the power device to generate the second turning force, the control unit is configured to:

if the rotational speed of the propeller is 0, set the output direction of the thrust force to the port-starboard direction, and if the rotational speed of the propeller is not 0, set the output direction of the thrust force to a direction in which the second turning force acts most effectively according to the rotational speed of the propeller and the steering angle.

Effects of the Invention

According to the first aspect, the magnitude of the thrust force of the power device is controlled according to the rotational speed of the propeller of the outboard motor and the steering angle corresponding to the operation of the steering mechanism, and the balance between the magnitude of the first turning force and the second turning force is changed. Accordingly, it is possible to generate the necessary turning force regardless of the state of the boat such as the thrust force of the outboard motor and the steering angle.

According to the second aspect, it is possible to generate the necessary turning force for realizing the predetermined turning performance of the boat by adding the first turning force and the second turning force.

Even when the necessary turning force cannot be obtained only by the first turning force since the rotational speed of the propeller is low or the steering angle is small, the necessary turning force can be generated by the sum of the first turning force and the second turning force by increasing the rate of the second turning force.

According to the fourth aspect, even when the outboard motor is in the neutral state, the boat can turn with the necessary turning force by operating the power device to generate the second turning force when the steering mechanism is operated.

According to the fifth aspect, even in a case where sudden steering is made when the rotational speed of the propeller is high and the thrust force of the outboard motor is great, in order to avoid overturning, the power unit adds the turning force instead of the control unit limiting the steering angle to the upper limit value. Therefore, the boat can turn rapidly and stably by the turning forces generated at two places, that is, the front (bow) and the rear (stern).

When the power device whose angle in the output direction of the thrust force is variable on the horizontal plane generates the second turning force, as in the sixth aspect, if the propeller of the outboard motor does not rotate and the outboard motor does not have a thrust force, the output direction of the thrust force of the power device is set to the post-starboard direction, and if the propeller of the outboard motor rotates and the outboard motor outputs the thrust force, the output direction of the thrust force of the power device is set to the direction in which the second turning force acts most effectively. Therefore, it is possible to obtain the second turning force using the thrust force of the power device efficiently.

DESCRIPTION OF EMBODIMENTS

Figure 1:
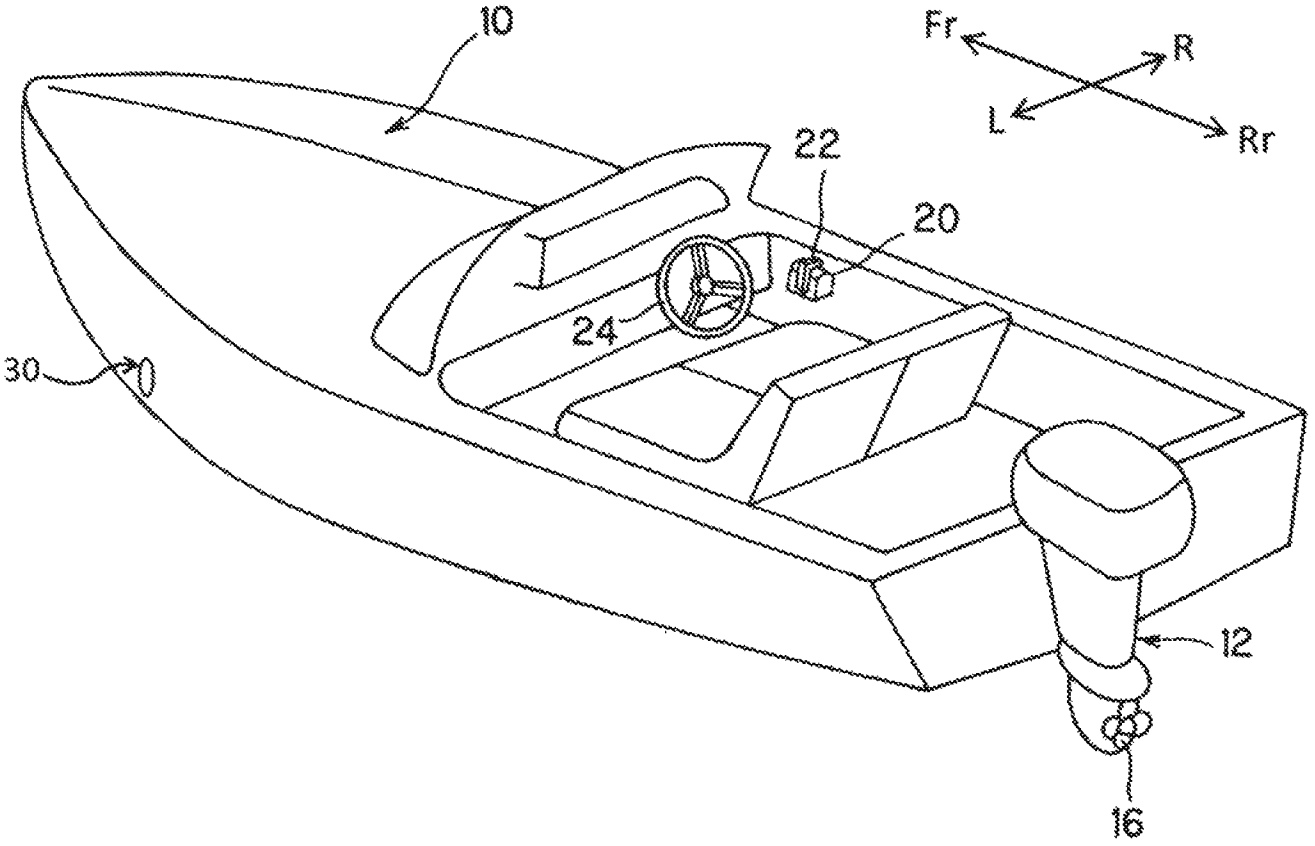
FIG. 1 is a perspective view of a boat including a boat maneuvering support device according to the present invention when viewed from an upper rear port side.

A boat maneuvering support device according to embodiments of the present invention will be described with reference to the drawings. The drawings are supposed to be seen based on a direction of reference numerals. In the drawings, a bow direction is denoted by Fr, a stern direction is denoted by Rr, a port side is denoted by L. and a starboard side is denoted by R.

Figure 2:
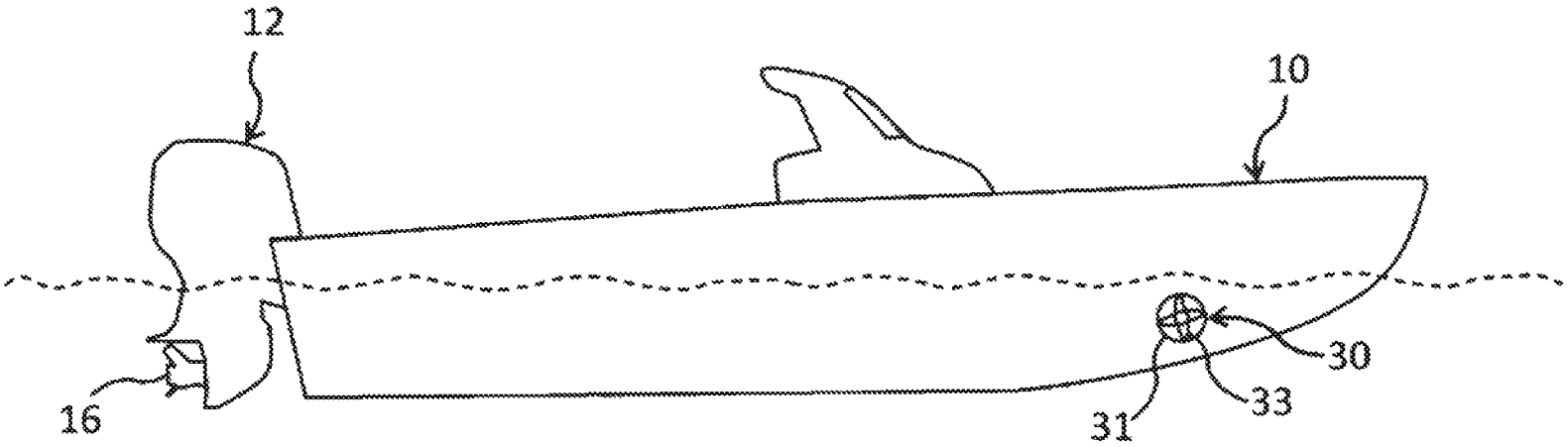
FIG. 2 is a side view of the boat shown in FIG. 1 when viewed from a starboard side.

FIG. 1 is a perspective view of a boat including a boat maneuvering support device according to the present invention when viewed from an upper rear port side. FIG. 2 is a side view of the boat shown in FIG. 1 when viewed from a starboard side. As shown in FIGS. 1 and 2, an outboard motor 12 is mounted on a stern of the boat. The outboard motor 12 includes a propeller 16, a gear (not shown), an engine (not shown), and a steering mechanism (not shown). The propeller 16 is rotated by power of the engine transmitted via the gear and generates a thrust force for propelling a hull 10. The outboard motor 12 is set to one of a forward state, a neutral state, and a backward state by the selection of the gear. The steering mechanism is a mechanism for changing a left-right angle (a steering angle) of a shaft (a propeller shaft) of the propeller 16 with respect to an outboard motor body. The steering mechanism is not limited to a mechanism which changes the left-right angle of the propeller shaft and may be a rudder provided rearward of the propeller 16.

A tunnel 31 penetrating the left and right of the hull 10 is provided at the hull 10 on a front (bow) side of the boat and provided lower than a waterline. A propeller 33 which produces the thrust force in a port-starboard direction by a rotational power of an electric motor (not shown) is installed in the tunnel 31 located at an intersection of a line connecting the bow with the stern and the tunnel 31. That is, in the boat shown in FIGS. 1 and 2, a side thruster (hereinafter simply referred to as a "thruster") 30 is provided at a bow side. The thruster 30 outputs the thrust force in the port-starboard direction of the boat.

A remote control box 20 is disposed in the vicinity of an operator seat of the hull 10. The remote control box 20 includes a lever 22 which is freely operated by an operator. The lever 22 freely swings from an initial position in the front-rear direction (a frontward direction and a rearward direction of the operator), and a shift change instruction of the gear from the operator and an instruction to adjust the engine rotational speed are input to the lever 22. Further, in the vicinity of the operator seat, a freely rotated steering wheel 24 is disposed. A turning instruction from the operator is input to the steering wheel 24, and by operating the steering wheel 24, the turning mechanism of the outboard motor 12 functions to change the steering angle. The operation of the thruster 30 is controlled according to the magnitude of the thrust force of the outboard motor 12 and the steering angle when the steering wheel 24 is operated.

Figure 3:
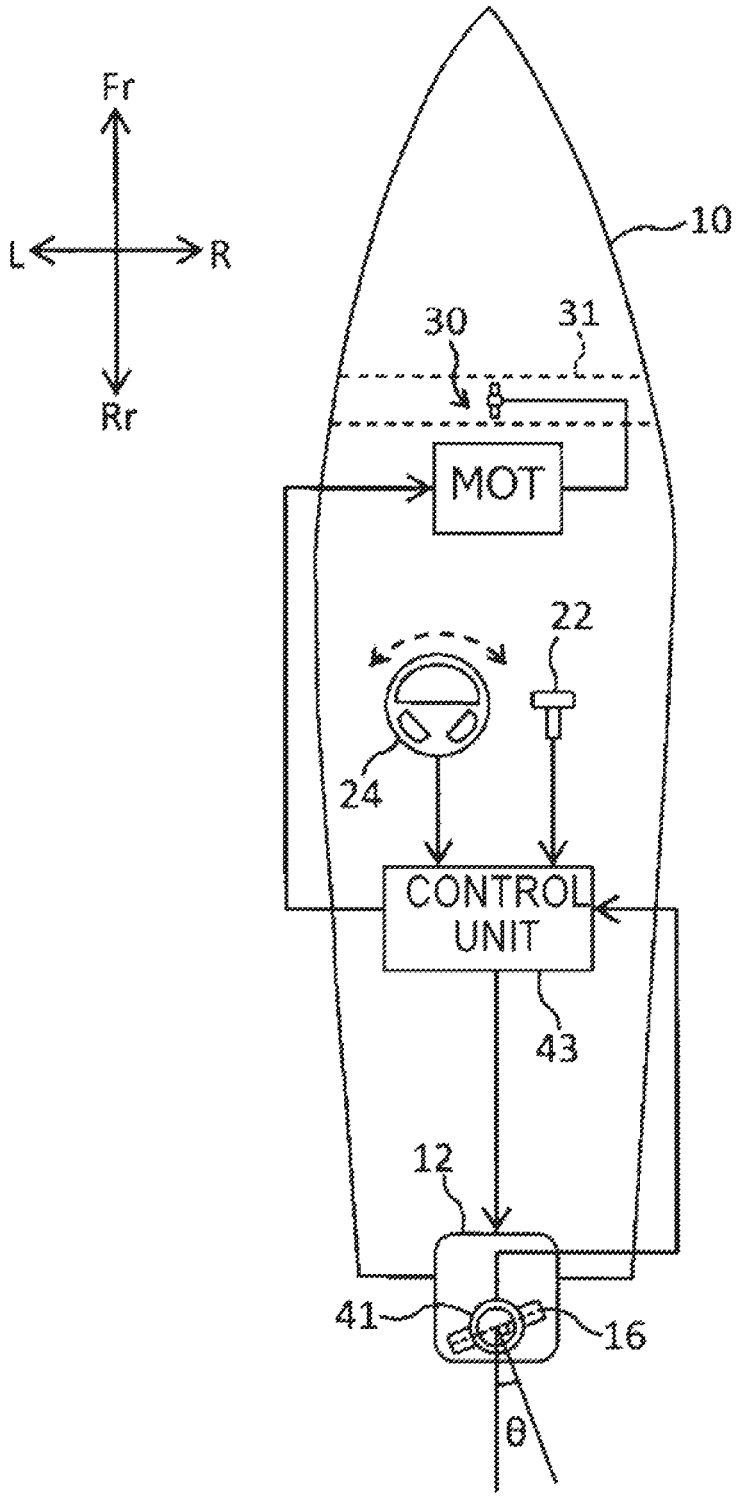
FIG. 3 is a schematic view showing a hull when the boat shown in FIG. 1 is viewed from the above and a configuration of the boat maneuvering support device provided in the boat.

FIG. 3 is a schematic view showing the hull 10 when the boat shown in FIG. 1 is viewed from the above and a configuration of the boat maneuvering support device for the boat. The boat maneuvering support device according to the present embodiment controls the magnitude of the thrust force of the thruster 30 according to the magnitude of the thrust force of the outboard motor 12 and the steering angle corresponding to the operation of the steering wheel 24 so as to change a balance between the magnitude of a first turning force which makes the boat turn by the thrust force of the outboard motor 12 and the magnitude of a second turning force which makes the boat turn by a thrust force of the thruster 30. Accordingly, the necessary turning force is generated regardless of a state of the boat such as the thrust force and the steering angle of the outboard motor 12. To this end, the boat maneuvering support device includes a rotational speed detection unit 41 and a control unit 43.

The rotational speed detection unit 41 detects rotational speed of the propeller 16 of the outboard motor 12. A signal indicating the rotational speed detected by the rotational speed detection unit 41 is sent to the control unit 43. The control unit 43 controls the magnitude of a thrust force output by the thruster 30 according to a rotational speed Ne obtained from the rotational speed detection unit 41 and the steering angle θ corresponding to the operation of the steering wheel 24 so as to change the balance between the magnitude of the first turning force and the magnitude of the second turning force. Hereinafter, control contents controlled by the control unit 43 will be described in detail.

First, the calculation of the first turning force which makes the boat turn by the thrust force of the outboard motor 12 will be described. The thrust force P of the outboard motor 12 is obtained by multiplying the rotational speed Ne of the propeller 16 of the outboard motor 12 obtained from the rotational speed detection unit 41 by a constant c(Ne) specific to the propeller 16 which changes according to the rotational speed Ne. The first turning force R1 is a value obtained by multiplying the thrust force P of the outboard motor 12 by the steering angle θ. Therefore, the first turning force R1 is expressed by the following expression (1):

$$R1=c(Ne)\times Ne\times 0 \quad (1)$$

Figures 4A, 4B, 4C:
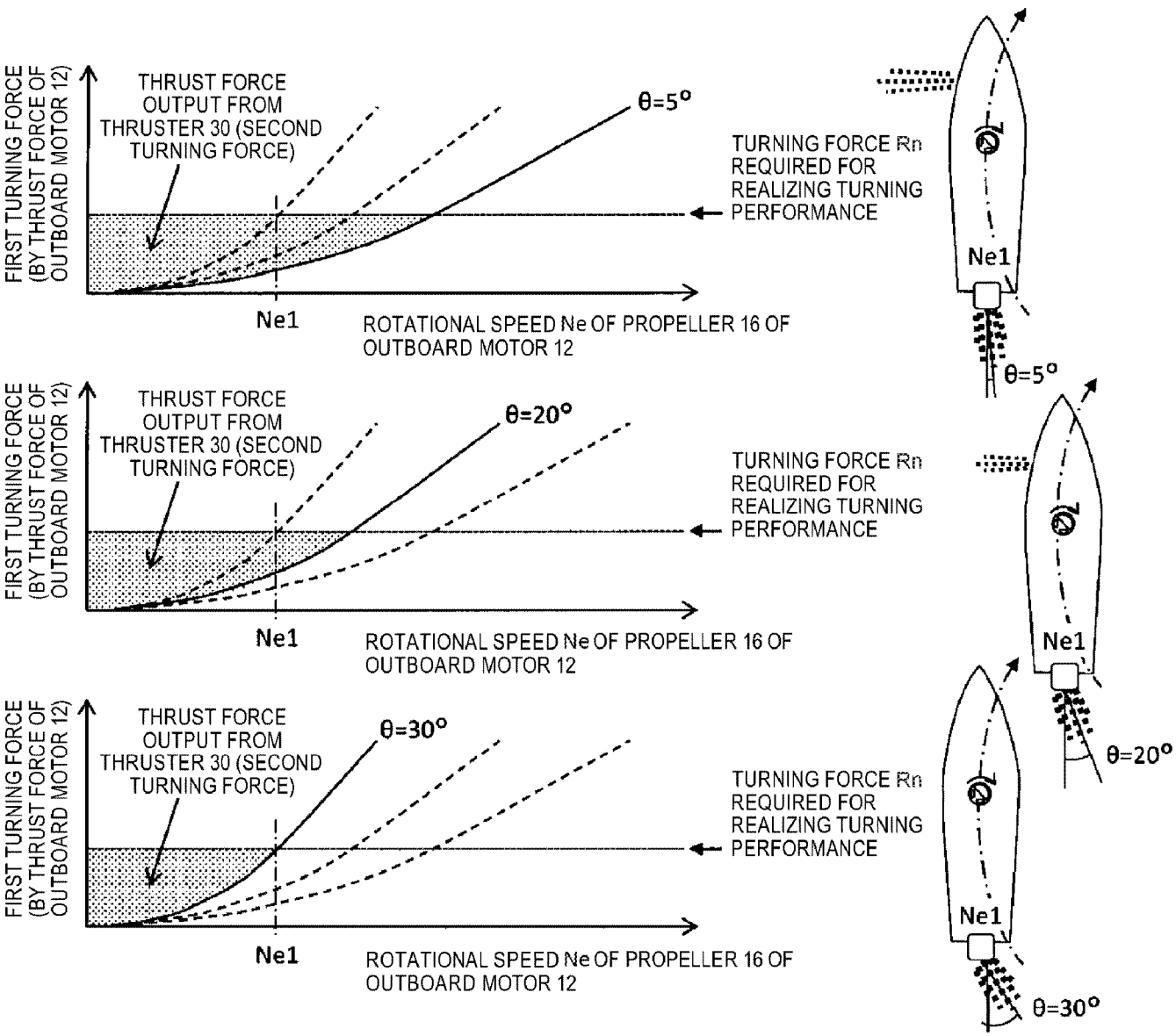
FIGS. 4A to 4C are diagrams showing a relationship among a first turning force, a rotational speed of a propeller of an outboard motor, and a steering angle, and examples of a balance between the first turning force and a second turning force with respect to a turning force necessary for realizing a turning performance of the boat shown in FIG. 1.

FIGS. 4A to 4C are diagrams showing a relationship among the first turning force R1, the rotational speed Ne of the propeller 16 of the outboard motor 12, and the steering angle θ, and examples of a balance between the first turning force R1 and the second turning force R2 with respect to the turning force Rn required for realizing a turning performance of the boat shown in FIG. 1. As shown in FIGS. 4A to 4C, the first turning force R1 increases as the rotational speed Ne of the propeller 16 of the outboard motor 12 increases regardless of the magnitude of the steering angle θ. Therefore, if the first turning force R1 corresponding to the rotational speed Ne of the propeller 16 of the outboard motor 12 does not reach the turning force Rn necessary for realizing the turning performance of the boat in the present embodiment, the control unit 43 operates the thruster 30 to generate the second turning force R2 in either left or right direction.

In the meantime, the rate of increase of the first turning force R1 with respect to the change of the rotational speed Ne increases as the steering angle θ increases. Therefore, as shown in FIGS. 4A to 4C, even with the same rotational speed Ne1, although the necessary turning force Rn can be realized only with the first turning force R1 when the steering angle θ is 30 degrees, the necessary turning force Rn cannot be realized only with the first turning force R1 when the steering angle θ decreases to 20 degrees or 5 degrees. As described above, since the first turning force R1 depends on not only the rotational speed Ne of the propeller 16 of the outboard motor 12 but also the steering angle θ, the control unit 43 operates the thruster 30 if the first turning force R1 is less than the necessary turning force Rn and controls the magnitude of the thrust force (the second turning force) output by the thruster 30 so as to change the balance of between the magnitude of the first returning force and the magnitude of the second returning force. That is, the control unit 43 increases the rate of the second turning force as the first turning force R1 decreases and generates the necessary turning force Rn by the sum of the first turning force R1 and the second turning force R2.

As described above, according to the present embodiment, the magnitude of the thrust force of the thruster 30 is controlled according to the rotational speed Ne of the propeller 16 of the outboard motor 12 and the steering angle θ corresponding to the operation of the steering wheel 24, the balance between the magnitude of the first turning force R1 and the second turning force R2 is changed, and the first turning power R1 is added to the second turning power R2. Accordingly, it is possible to generate the turning force Rn necessary for realizing the predetermined turning performance of the boat regardless of the state of the boat such as the thrust force of the outboard motor 12 and the steering angle θ. Even when the necessary turning force Rn cannot be obtained only by the first turning force R1 since the rotational speed Ne of the propeller 16 is low or the steering angle θ is small, the necessary turning force Rn can be generated by the sum of the first turning force R1 and the second turning force R2 through increasing the rate of the second turning force R2.

Incidentally, the present invention is not limited to the above-described embodiment and may be appropriately modified, improved, or the like. For example, when the outboard motor 12 is set in the neutral state by the operation of the lever 22, if the steering wheel 24 is operated and the steering angle θ exceeds a predetermined value (for example, 5 degrees), the control unit 43 may control the thruster 30 to output the thrust force (the second turning force) having the same magnitude as the necessary turning force Rn in a direction corresponding to positive or negative of the steering angle θ. Accordingly, even when the outboard motor 12 is in the neutral state, the boat can turn with the necessary turning force Rn by operating the thruster 30 to generate the second turning force when the steering wheel 24 is operated.

Further, when the steering wheel 24 is operated at an angular velocity equal to or higher than a threshold in a state where the rotational speed Ne of the propeller 16 of the outboard motor 12 is equal to or higher than a predetermined value, the control unit 43 limits the steering angle θ to a predetermined upper limit value and operates and controls the thruster 30 to output the thruster in a direction opposite to a turning direction. Accordingly, even in a case where sudden steering is made when the rotational speed Ne of the propeller 16 is high and the thrust force of the outboard motor 12 is great, in order to avoid overturning, the thruster 30 adds the turning force instead of the control unit 43 limiting the steering angle θ to the upper limit value. Therefore, the boat can turn rapidly and stably by the turning forces generated at two places, that is, the front (bow) and the rear (stern). The predetermined upper limit value is set to a value lower than the steering angle with a full starboard or a full port.

Figure 5A:
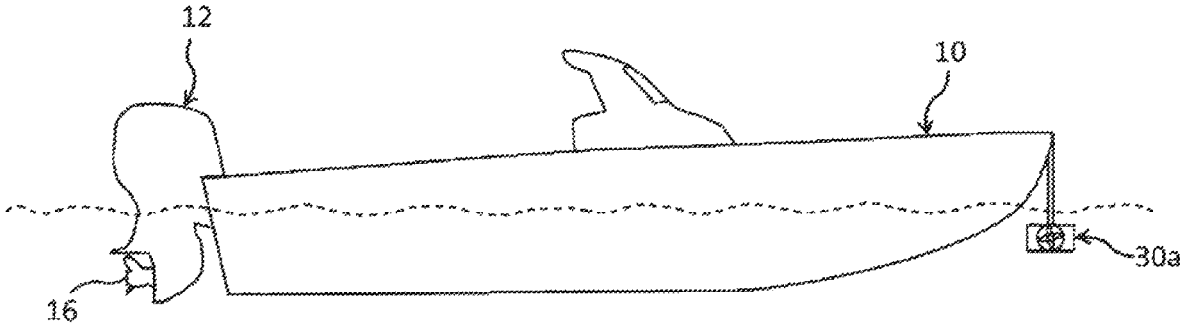
FIG. 5A is a side view of a boat according to another embodiment when viewed from the starboard side.
Figure 5B:
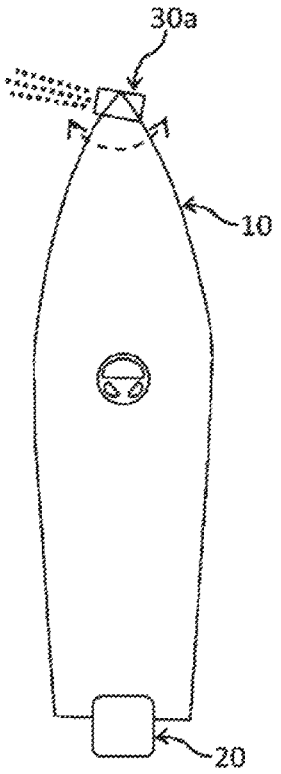
FIG. 5B is a schematic view when the boat is viewed from the above.
Figure 5C:
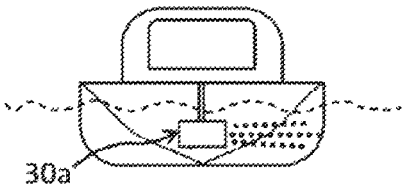
FIG. 5C is a front view of the boat.

Although the thruster 30 provided in the boat of the embodiment is a tunnel-thruster provided inside the tunnel 31 provided in the hull 10, a thruster 30*a* shown in FIG. 5 which has a structure where the propeller for producing a thrust force in the port-starboard direction is suspended from the bow to a lower side of the waterline may be provided.

Further, as shown in FIG. 5B, the angle of the output direction of the thrust force of the thruster 30*a* with respect to the port-starboard direction may be changeable on a horizontal plane. In this case, when the thruster 30*a* outputs the thrust force (the second turning force), if the rotational speed Ne of the propeller 16 of the outboard motor 12 is 0, the output direction of the thrust force of the thruster 30*a* is set to the port-starboard direction, and if the rotational speed Ne is not 0, the output direction of the thrust force of the thruster 30*a* is set to a direction in which the second turning force acts most effectively according to the rotational speed Ne and the steering angle θ. Accordingly, it is possible to obtain the second turning force which uses the thrust force of the thruster 30*a* efficiently.

DESCRIPTION OF REFERENCE NUMERALS

10 hull
12 outboard motor
16 propeller
20 remote control box
22 lever
24 steering wheel
30 thruster
31 tunnel
33 propeller
41 rotational speed detection unit
43 control unit

The invention claimed is:

1. A boat maneuvering support device for a boat including an outboard motor which is mounted on a stern of the boat and whose steering angle is variable, a power device which is configured to output a thrust force in a port-starboard direction of the boat, and a steering mechanism which is configured to change the steering angle, the boat maneuvering support device comprising:

a rotational speed detection unit which is configured to detect a rotational speed of a propeller of the outboard motor; and a control unit which is configured to control a magnitude of the thrust force output by the power device according to the rotational speed of the propeller and the steering angle corresponding to the operation of the steering mechanism, wherein the control unit is configured to control the magnitude of the thrust force output by the power device so as to change a balance between a magnitude of a first turning force which makes the boat turn by a thrust force of the outboard motor and a magnitude of a second turning force which makes the boat turn by the thrust force of the power device, and wherein when the steering mechanism is operated at an angular velocity equal to or higher than a threshold in a state where the rotational speed of the propeller is equal to or higher than a predetermined value, the control unit is configured to limit the steering angle to an upper limit value and control the power device to output the thrust force in a direction opposite to a turning direction.

2. The boat maneuvering support device according to claim 1, wherein a sum of the first turning force and the second turning force is equal to a turning force required for realizing a predetermined turning performance of the boat.

3. The boat maneuvering support device according to claim 1, wherein the control unit is configured to increase a rate of the second turning force as the rotational speed of the propeller or the steering angle decreases.

4. The boat maneuvering support device according to claim 1, wherein when the steering mechanism is operated in a state where the outboard motor is in a neutral state, the control unit is configured to control the power device to generate the second turning force.

5. The boat maneuvering support device according to claim 1, wherein an angle of an output direction of the thrust force of the power device with respect to the port-starboard direction is changeable on a horizontal plane, and wherein in a case of controlling the power device to generate the second turning force, the control unit is configured to:

if the rotational speed of the propeller is 0, set the output direction of the thrust force to the port-starboard direction, and if the rotational speed of the propeller is not 0, set the output direction of the thrust force to a direction in which the second turning force acts most effectively according to the rotational speed of the propeller and the steering angle.

* * * * *